United States Patent [19]

Bando

[11] 4,228,617

[45] Oct. 21, 1980

[54] METHOD FOR GRINDING GLASS PLATES AND THE LIKE THROUGH NUMERICAL CONTROL AND BEVELING MACHINE THEREFOR

[75] Inventor: Shigeru Bando, Tokushima, Japan

[73] Assignee: Bando Kiko Co., Ltd, Tokushima, Japan

[21] Appl. No.: 968,774

[22] Filed: Dec. 12, 1978

[30] Foreign Application Priority Data

| | | | |
|---|---|---|---|
| Dec. 31, 1977 | [JP] | Japan | 52/158164 |
| Feb. 6, 1978 | [JP] | Japan | 53/012788 |
| Mar. 5, 1978 | [JP] | Japan | 53/025109 |
| Mar. 6, 1978 | [JP] | Japan | 53/025838 |
| Sep. 9, 1978 | [JP] | Japan | 53/110850 |
| Sep. 24, 1978 | [JP] | Japan | 53/116994 |

[51] Int. Cl.[3] ..... B24B 9/10

[52] U.S. Cl. ..... 51/3; 51/119; 51/165 TP; 51/283 E

[58] Field of Search ..... 51/3, 283 E, 165 TP, 51/165.71, 119

[56] References Cited

U.S. PATENT DOCUMENTS

| | | | |
|---|---|---|---|
| 1,950,758 | 3/1934 | Sommer | 51/3 |
| 2,600,127 | 6/1952 | Reaser | 51/3 |
| 2,715,796 | 8/1955 | Beard | 51/3 |
| 2,982,062 | 5/1961 | Jackson | 51/3 |
| 3,187,467 | 6/1965 | Cortesi | 51/283 E |
| 3,344,559 | 10/1967 | Inaba | 51/165 TP |

FOREIGN PATENT DOCUMENTS

| | | | |
|---|---|---|---|
| 368013 | 6/1973 | U.S.S.R. | 51/283 E |

*Primary Examiner*—Harold D. Whitehead

*Attorney, Agent, or Firm*—Stevens, Davis, Miller & Mosher

[57] ABSTRACT

A beveling machine having a table provided with a plurality of fixing stands in tandem for fixing glass plates and a head stand carrying working heads equipped with working wheels rotatably in the same number as the fixing stands comprises means for causing the table and the working heads to conduct a relative movement in two directions in a horizontal plane, means for spinning the working wheels around a vertical axes. The relative movement of the table and the working heads in the two directions and the spinning movement of the working wheels around the vertical axes in the machine are controlled by a numerical control device in which the face of the glass plates to be ground and the grinding face of the grinding wheels are always kept at substantially a same contact angle.

14 Claims, 14 Drawing Figures

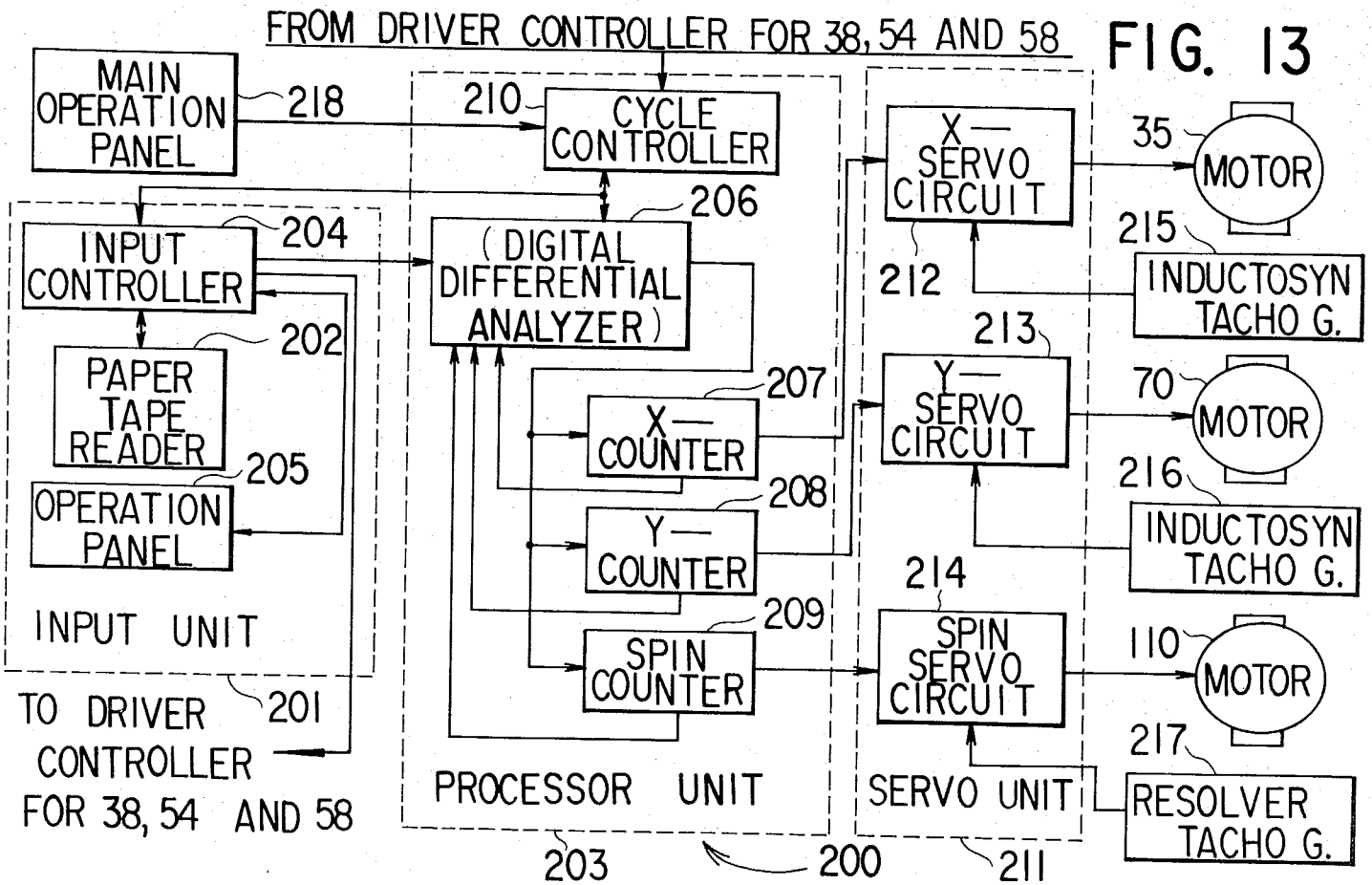
FIG. 13
FROM DRIVER CONTROLLER FOR 38, 54 AND 58
MAIN OPERATION PANEL
218
CYCLE CONTROLLER
210
206
(DIGITAL DIFFERENTIAL ANALYZER)
INPUT CONTROLLER
204
PAPER TAPE READER
202
OPERATION PANEL
205
INPUT UNIT
201
TO DRIVER CONTROLLER FOR 38, 54 AND 58
X— COUNTER
207
Y— COUNTER
208
SPIN COUNTER
209
PROCESSOR UNIT
203
200
X— SERVO CIRCUIT
212
Y— SERVO CIRCUIT
213
SPIN SERVO CIRCUIT
214
SERVO UNIT
211
MOTOR
35
INDUCTOSYN TACHO G.
215
MOTOR
70
INDUCTOSYN TACHO G.
216
MOTOR
110
RESOLVER TACHO G.
217

METHOD FOR GRINDING GLASS PLATES AND THE LIKE THROUGH NUMERICAL CONTROL AND BEVELING MACHINE THEREFOR

FIELD OF THE INVENTION

This invention concerns a method for grinding glass plates through numerical control for beveling glass plates in various shapes with various curves such as of circular, elliptical, rectangular or like other form under the control of a machine through numerical instruction, as well as a beveling machine controlled by such numerical control.

BACKGROUND OF THE INVENTION

For example, beveling for glass plates usually requires successive working steps such as edging (edge cutting or grinding), bevel-cutting, bevel-grinding for grinding bevel-cut face (smoothing by grinder or the like) and the step for polishing the bevel-ground face. In automatic beveling for glass plates of various shapes, working heads and thus working wheels in each of the working steps have to be arranged so that they run along the glass plate edges and the movement of each of the working wheels should be controlled respectively. Since there are a number of operations to be controlled where all of the movements of the working wheels in each of the above steps are individually controlled, many and intricate and elaborate control units are required and the program for preparing a control tape is complicated and difficult.

SUMMARY OF THE INVENTION

Accordingly, it is an object of this invention to provide a beveling machine in which a group of working wheels conducting various complicated movements for the working in each of the above working steps are connected so that each of the working wheels conducts a same movement, and the working movements in each of the steps are put to numerical control simultaneously by a reduced number of numerical control devices.

Another object of this invention is to provide a high speed automatic beveling machine in which the devices for conducting each of the above working steps are successively arranged linearly in a row and glass plates are automatically fed, conveyed and automatically positioned to the devices in each of the working steps.

Another object of this invention is to provide a beveling machine in which grinding wheels are provided as the working wheel slantwise to the vertical axis in specified working heads among a plurality of working heads having a rotatable working wheel each by one, and the grinding wheels are adapted to spin around the vertical axis so that the grinding face of the grinding wheels and the face of the glass plates to be ground and always kept substantially at a same contact angle, and the grinding wheels grind the glass plates to be ground at substantially a same portion of the grinding face.

A further object of this invention is to provide a beveling machine in which the movement of the working wheels in the direction of two axes (X axis and Y axis) in a horizontal plane and the spinning movement of each of grinding wheels are adapted to be put under numerical control.

A still further object of this invention is to provide a grinding method for glass plates which comprising fixing the glass plates on a plurality of fixing stands mounted in tandem on a table, and moving relatively the glass plates and working wheels in biaxial directions in a horizontal plane while rotating each working wheel held on each of plurality of working heads mounted in tandem opposing each fixing stand respectively as well as spinning working wheels around a vertical axis, wherein the relative movement in the horizontal plane of the glass plates and the working wheels and the spinning movement of the working wheels are controlled by the numerical control device.

The beveling machine according to this invention comprises a table having a plurality of fixing stands in tandem for fixing glass plates, a head stand carrying a plurality of working heads each having a rotatably mounted working wheel respectively, means for moving the head stand in one direction in a horizontal plane so as to move a plurality of working wheels in one direction in the horizontal plane, means for moving the table or the head stand in the direction perpendicular to the above one direction in the horizontal plane so as to cause a plurality of working wheels to conduct a relative movement in the direction perpendicular to the above one direction in the horizontal plane, means mounted on the above head stand for spinning the grinding wheels provided inclinedly from a vertical axis in specified working heads among the above working head around a vertical axis, and a numerical control device for controlling the movements in the biaxial directions in the horizontal plane of the working wheels and the spinning movement around the vertical axis of the grinding wheels, wherein the spinning center of the working wheel is situated at the ground portion of the glass plate.

Those working heads other than one working head among a plurality of working heads which is employed for edging, that is, cutting and grinding glass plates and has a grinding wheel rotating around an axis perpendicular to the face of the glass plates to be cut and ground are used for bevel-cutting glass plates, grinding the bevel-cut portion and polishing the ground portion and they are collectively referred to as "grinding" or "grinding wheels" against the above "edging" or "edging wheel" sometimes in the present specification and claims. Since the grinding wheels which are the working wheel provided to the specified working heads for grinding are adapted so that they conduct grinding while rotating around the shafts slanted to the face of the glass plates to be ground (that is, the face to be bevel-cut, ground and polished), they are constituted in such a way that they spin around the vertical axis going through a grinding portion as the grinding proceeds so as to contact substantially the same portion of the grinding face of the grinding wheels with the portion of the glass plates to be ground. While the edging wheel may or may not spin around the vertical axis going through substantially the center of a shaft attaching the wheel.

In one embodiment of this invention, a plurality of fixing stands are secured on a table and the table moves in the direction in perpendicular to the moving direction of the above head stand, so as to ensure the movement in the biaxial directions, that is, in the directions of X axis and Y axis in the horizontal plane together with the movement of the head stand. The head stand moves a plurality of working heads simultaneously in one direction in the horizontal plane and, while on the other hand, the table moves a plurality of fixing stands simultaneously in the direction perpendicular to the above direction by which a plurality of glass plates placed on the fixing stands are worked simultaneously by the working wheels provided to the working heads. In another embodiment, the table is fixed and the head stand moves in the directions of X axis and Y axis in the horizontal plane, by which the glass paltes securely set on the table are simultaneously worked by the working wheels provided to each of the working heads on the head stand. In the former embodiment, a same result is provided as in the working wheels moving biaxially in the horizontal plane and the glass plates are worked on its periphery in various kinds of the shapes such as having various curves as circular, elliptical or rectangular form.

Vacuum attraction devices are provided to the fixing stands so as to attract and set the glass plates during working. The vacuum attraction may be effected by starting the operation of a vacuum pump based on the detection of mounting of the glass plates on the fixing stands by a timer actuated after the feeding means have stopped its operation or a detection switch provided on the fixing stands, or otherwise, the vacuum attraction may be effected by opening the vacuum port by the weight of the glass plate itself as shown in the embodiment.

Accordng to the embodiment of this invention, the feeding means for conveying the glass plate from one fixing stand to the succeeding fixing stand consists of a belt conveyor and it is adapted so that the belt rises upon conveying operation to receive the glass plate on the fixing stand thereon and descends after the completion of the conveying operation to a predetermined position to transfer the glass plates from the belt to the fixing stand.

While the conveying work of the glass paltes to a predetermined position by the feeding means can also be controlled by numerical control device, such a control is optional and it is essential in this invention to control at least the biaxial movement in a horizontal plane and the spinning movement around the vertical axis of the working wheels by a numerical control device. These and other object, as well as advantageous features of this invention will be made clear by the following detailed descriptions referred to the accompanying drawings in which:

FIG. 13 is a block diagram of numerical control device.

DETAILED DESCRIPTION OF THE INVENTION

Figure 1:
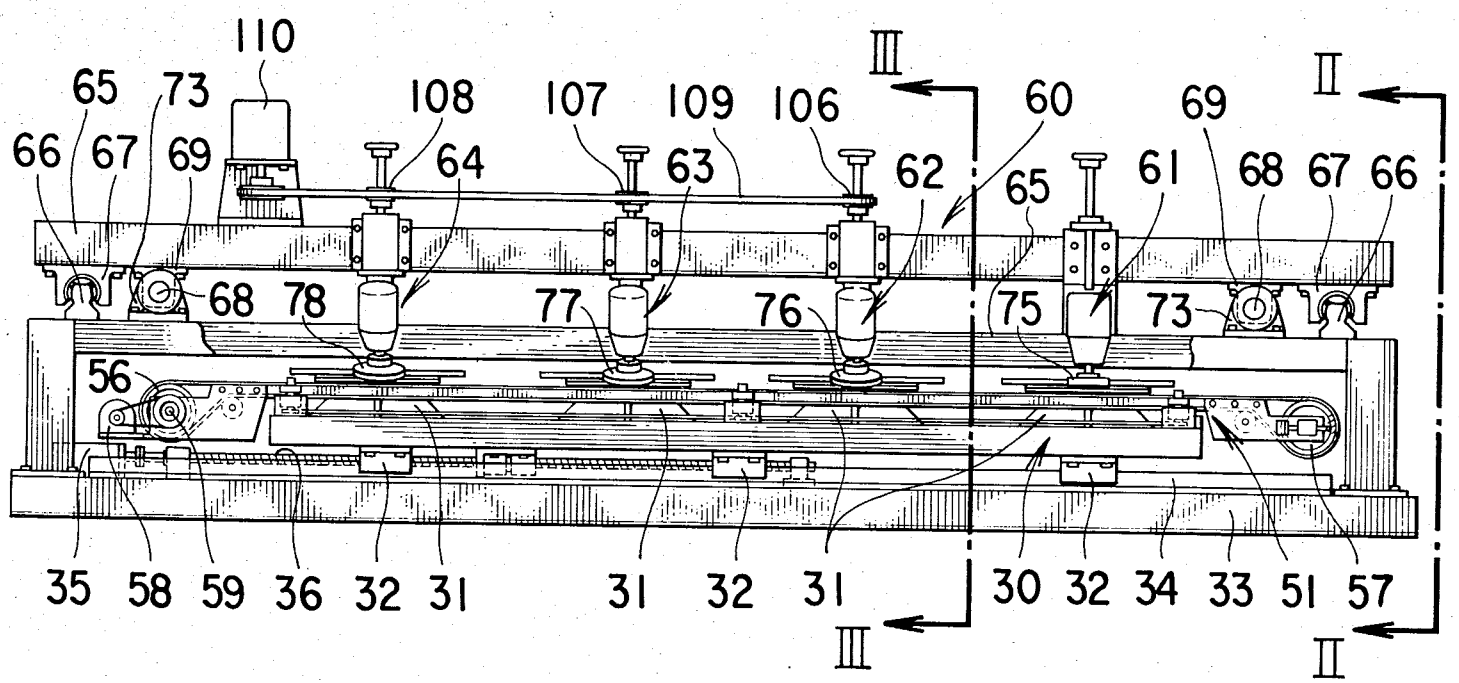
FIG. 1 is a front view of a first embodiment of the machine according to the present invention.
Figure 2:
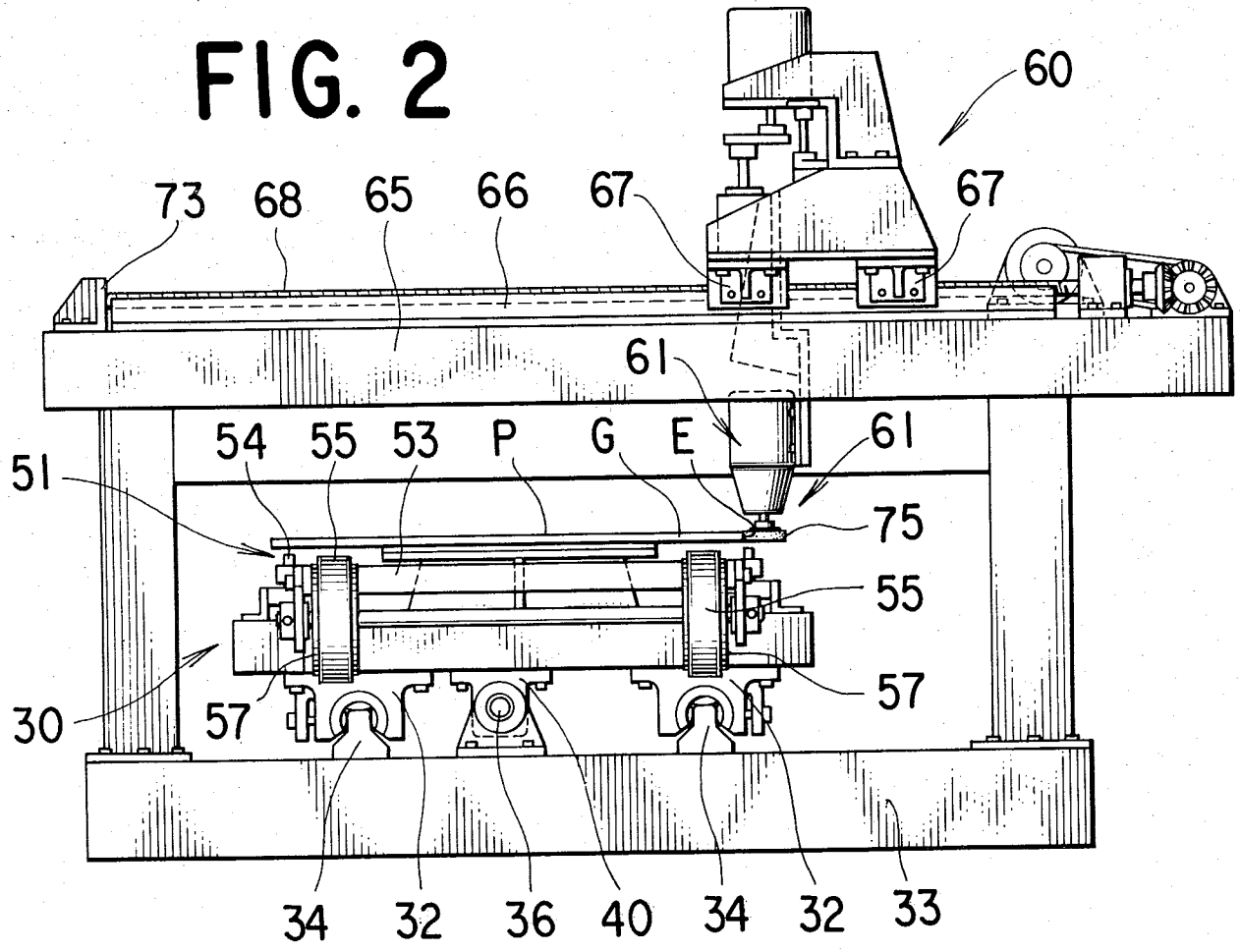
FIG. 2 is a side view looked from a line II—II of FIG. 1, wherein an edging wheel is located at a position shifted for 180 degree from the location thereof shown in FIG. 1.
Figure 3:
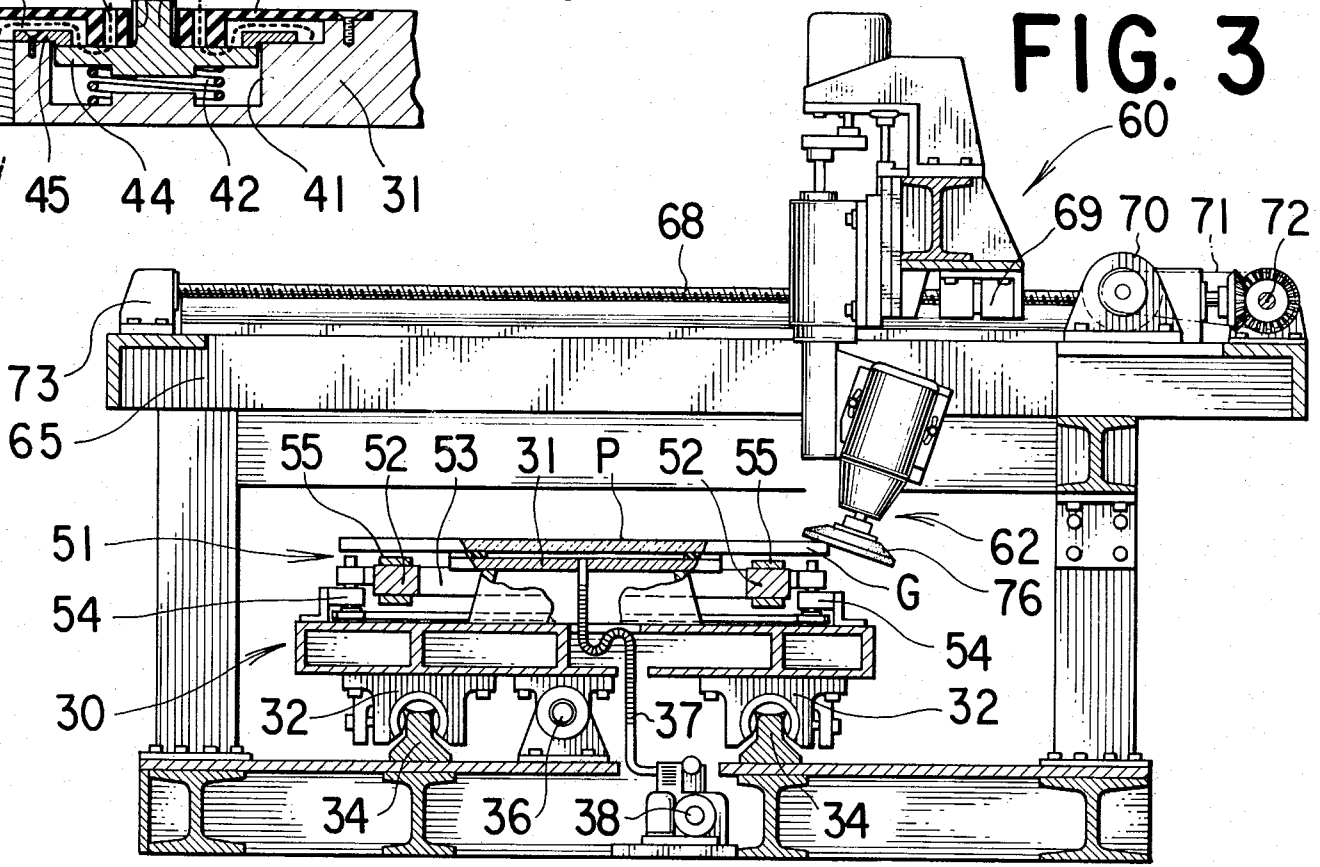
FIG. 3 is a cross sectional view taken along a line III—III of FIG. 1, wherein a grinding wheel is located at a position shifted for 180 degree from the location thereof shown in FIG. 1.
Figure 4:
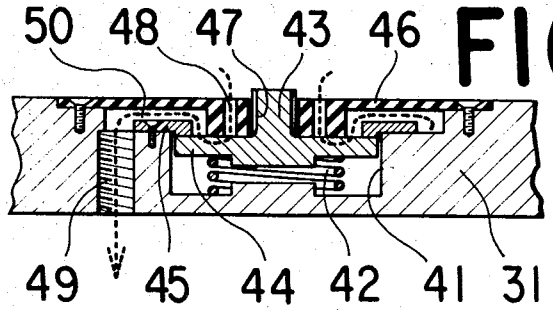
FIG. 4 is a detailed cross sectional view of a fixing stand.

As shown in FIG. 1 through FIG. 3, a table 30 carrying glass plates thereon and for conducting the movement in one direction, for example, in the direction of X axis in a horizontal plane has four glass plates fixing stands 31 disposed in an equi-space on its upper side and engages by its lower side through slide bearings 32 to guide rails 34 laid on a base 33 and moves to right and left in FIG. 1 advanced and retracted through nut 40 by a screw shaft 36 rotated from a servo motor 35. Each of the fixing stands 31 is connected by way of a flexible hose 37 to a vacuum device 38 as shown in FIG. 3 to attract and fix a glass plate mounted on each of them during working. The vacuum port is formed as shown in FIG. 4, in which a bore 41 is formed in the fixes stand 31, and a seal plate 44 having a central projection 43 is movably inserted in the bore while intervening therein a spring 42 and restricted by an annular retention plate 45 so as not to put out. A seal member 46 having a central aperture 47 is attached outside and a projection 43 is inserted into the aperture 47 and partially projected at its upper end to the outside. The seal member 46 is perforated with a plurality of holes 48 which are usually closed by the seal plate 44. A nipple for the connection of the hose is threaded into a threaded hole 49 and connected to the vacuum device. The vacuum attraction is not effected in the state shown in the figure but conducted upon mounting of the glass plate on the fixing stand 31, which urges the projection 43 downwardly to communicate the holes 48 by way of a channel 50 with the vacuum device.

A belt conveyor 51 is mounted vertically movably to the table 30. Frames 52, 52 disposed on both sides of the fixing stand 31 are connected at their front and rear ends by members 53. Screw feeding devices 54 known per se. is provided to elevate and descend the frames 52, 52 at a same time. Driving pulleys 56 and driven pulleys 57 are rotatably mounted respectively to each of the frames 52, 52 while securing the two driving pulleys to a driving shaft 59 and laid around with belts 55, 55 so that both of the belts are driven synchronously by a motor 58. The glass plate is conveyed from one fixing stand to another on the belt-conveyor 51 successively.

A head stand 60 has four working heads 61–64 at positions corresponding to the four fixing stands 31 and adapted to be movable in the direction perpendicular to the drawing sheet, that is, in the direction of Y axis on a frame 65 secured to the base 33. On the frame 65, are secured rails 66, 66 on which slide bearings 67, 67 mounted each in two on both longitudinal sides of the head stand 60 support the head stand movably on the rails 66, 66. While on the other hand, nuts 69 are secured on both sides of the head stand 60 and thread shafts 68, 68 meshing with the nuts are rotatably provided on both longitudinal sides of the frame 65. A servo motor 70 is mounted on the frame 65 connected through a timing belt 71 to shaft 72 disposed on the frame in parallel with the head stand 60, and both ends of the shaft 72 are engaged to the threaded shafts 68, 68 by way of bevel gears to rotate both of the thread shafts in a same direction, by which the head stand 60 is advanced and retracted. Reference numeral 73 represents bearings for rotatably receiving the thread shafts 68 and provided both ends of the thread shafts.

Each of the working heads mounted to the head stand 60 is arranged in the order of the working steps from the right to the left in FIG. 1. The working head 61 is for edging which merely cutting or grinding the end E of the glass plate G as shown in FIG. 2 and it is made of a disk-like diamond edging wheel 75 whose center of revolution is perpendicular to the face P of the glass plate to be ground. The working head 62 is for beveling which is made of a cup-like diamond wheel 76 whose center of revolution is slanted to the face P of the glass plate G to be ground as shown in FIG. 3. The working head 63 is for smoothing which grinds the portion of the glass plate beveled at the preceeding working head 62. It is composed of a cup-like grinding wheel 77 and disposed slantwise as the wheel 76 shown in FIG. 3. The working head 64 is for polishing which finishes the portion of the glass plate beveled and ground at the preceeding two steps and it is composed of a cup-like felt wheel 78 and disposed slantwise as the wheel 76 shown in FIG. 3.

Figure 5:
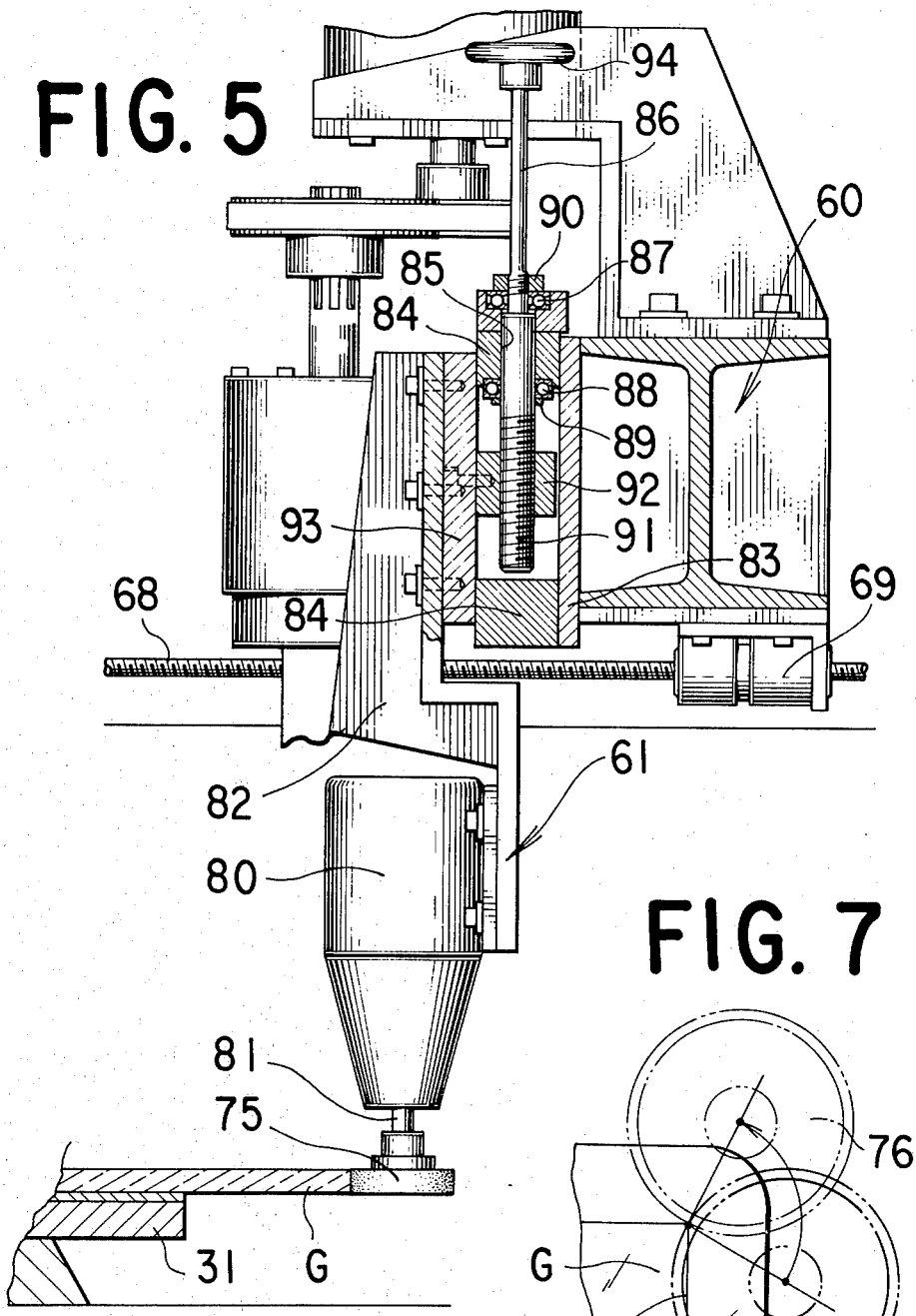
FIG. 5 is a detail view of the supporting portion of a working head which does not spin.

The working head 61 shown in FIG. 5 comprises a motor 80 and a wheel 75 attached to the output shaft 81 of the motor 80, and the motor 80 is secured to a motor support stand 82. Spacers 84, 84 are secures spaced apart to each other vertically to the front wall 83 of the head stand 60 in which a rod 86 is inserted into a through hole 85 formed in the upper spacer. Thrust bearings 87, 88 are disposed on the upper and the lower sides of the upper spacer while the lower thrust bearing 88 is received in a bearing receptacle 89 secured to the rod 86 and the upper thrust bearing 87 is urged by a bearing retention 90 having female threads threadingly engaging the threads on the rod 86. As a result, both of the thrust bearings are held between the bearing receptacle 89 and the bearing retention 90, and the rod 86 is supported rotatably to the upper spacer 84 but not movably axially. The rod 86 is formed at its lower end with a threaded portion 91 on which a nut 92 is to be threaded, so that a slide member 93 having the nut 92 can be slid up and down by the rotation of the rod 86 in a state contacting to the surfaces of the upper and the lower spacers 84, 84. Since the slide member 93 is secured with the motor support stand 82, the motor 80 can be moved vertically by turning a handle 94 attached to the upper end of the rod 86 thus to move the nut 92 vertically, whereby position control for the wheel 75 to the glass plate G can be attained.

Figure 7:
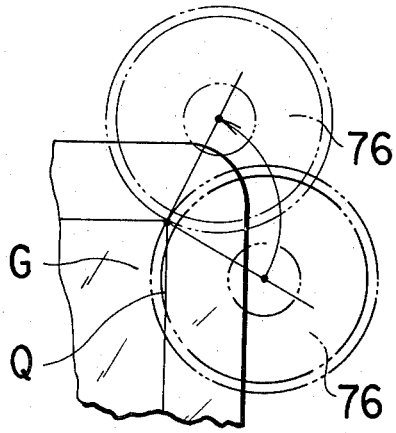
FIG. 7 is an explanatory view illustrating a grinding wheel in the status of spinning along the edge of a glass plate.
Figure 6:
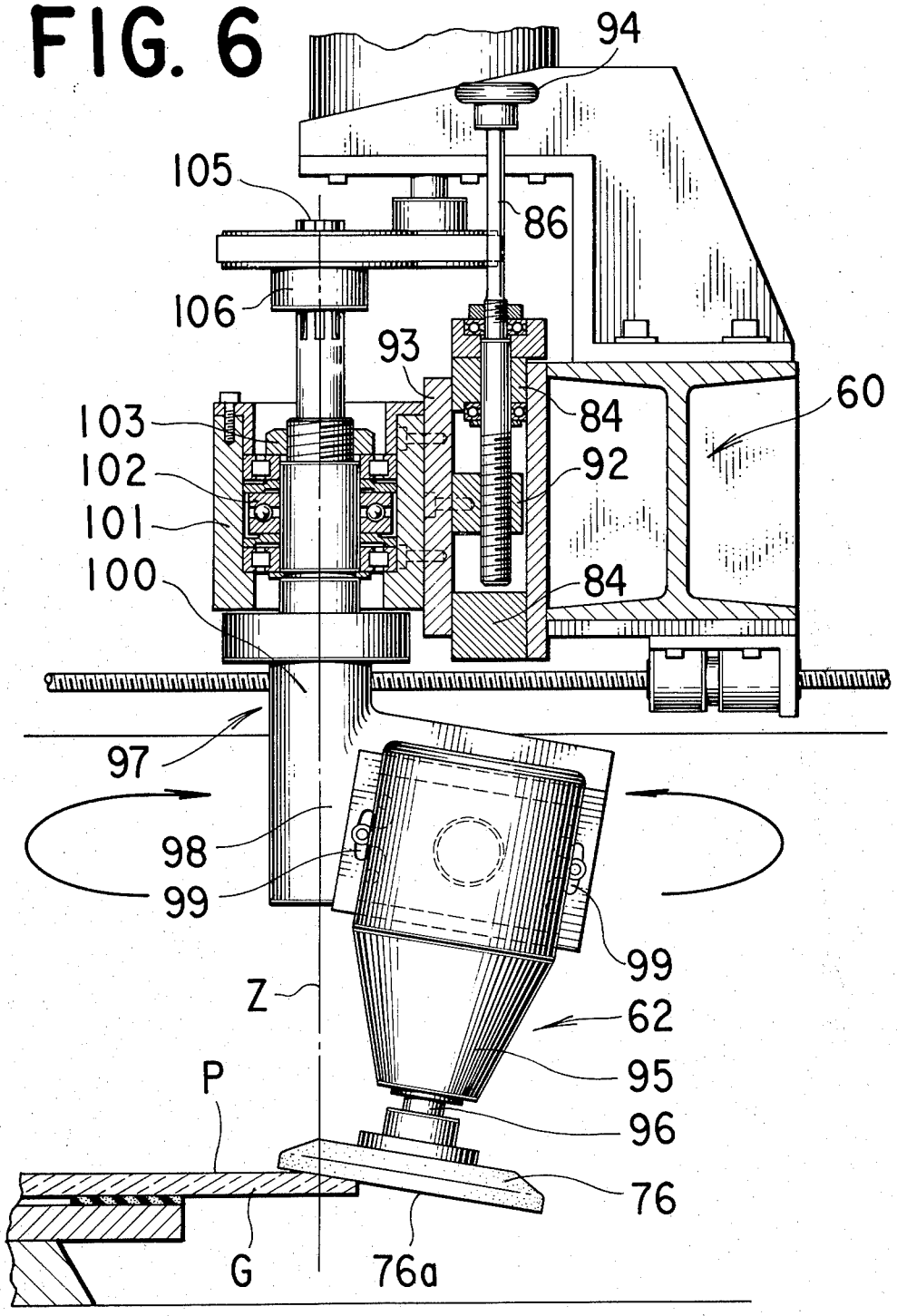
FIG. 6 is a detail view of the supporting portion of a working head for spinning.

The working head 62 shown in FIG. 6 (the structure is in common to the working heads 63 and 64 as described above) comprises a motor 95 whose output shaft 96 is slanted to the vertical line, a wheel 76 attached to the output shaft and a spinning device 97 for spinning the motor 95 around Z axis as the vertical line. The wheel 76 rotated by the motor 95 has such a structure that it rotates around the output shaft 96 as well as spin, around Z axis when employed for moving along the profile of the glass plate and grinding. With such a spinning structure, the grinding face **76*a* of the wheel 76 can always contact against the face P of the glass plate G to be ground substantially at a same grinding angle, and the glass plate are ground at substantially a same portion of the grinding face 76*a* to thereby uniformly grind the glass plate. The motor 95 is secured to a motor support stand 98 by inserting bolts into arc-shaped elongated holes 99, 98 and clamping them by nuts. Upon releasing the nuts, the motor 95 can pivot around the horizontal axis, so that the angle between the grinding face 76*a* of the wheel 76 and the face P of the glass plate G to be ground can be adjusted to optionally change the beveling angle. The motor support stand 98 is integrated with a rod 100 whose upper end passes through a housing 101 for the bearing and projects thereabove. While the rod 100 is hindered from axial movement relative to the housing 101 by a nut 103 threaded into the rod 100 on the upper side of a series of radial and thrust bearings 102 disposed in the housing, it is rotatably by way of the series of bearings 102. The housing 101 is secured to a slide member 93 and adapted to be movably up and down by the rotation of the rod 86. Since the details for the slide device have been already described, they are not repeated here. The upper end of the rod 100 is provided with a spline 105 and the rod 100 is vertically slidably against a pulley 106 having an aperture adapted to the spline 105. As shown in FIG. 1, each of pulleys 106, 107 and 108 for the working heads 62, 63 and 64 is connected by way of a timing belt 109 to a servo motor 110 so as to be rotated simultaneously. Consequently, the rod 100 for each of the working heads is rotated and the wheels 76, 77 and 78 spin around the Z axis. Since the Z axis is selected so as to situate at the grinding point for the glass plate, each of the wheels spins horizontally around the grinding point Q of the glass plate now under working as a center as shown in FIG. 7** and keeps its grinding angle always constant irrespective of the changes in the profile of the glass plate.

Figure 8:
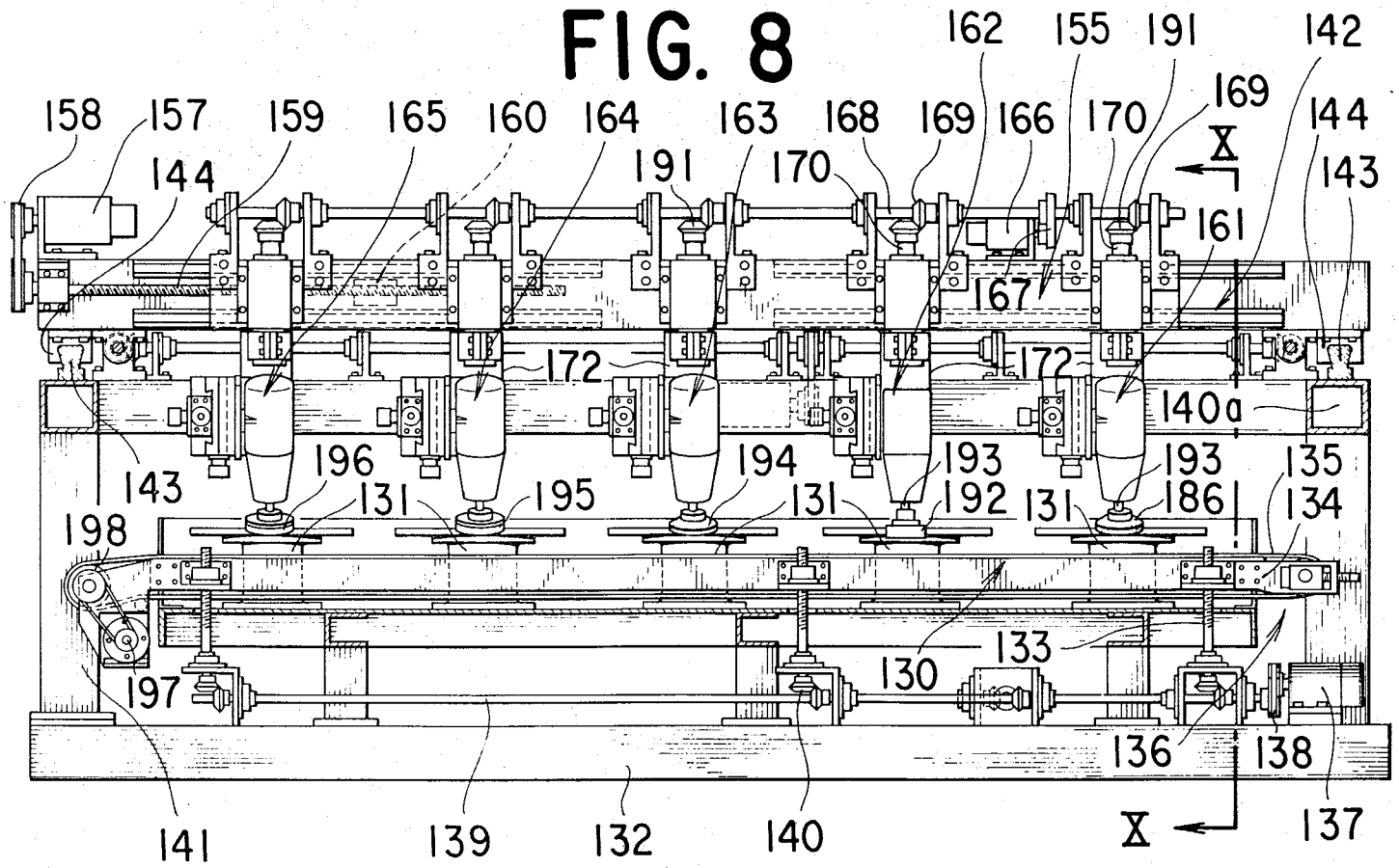
FIG. 8 is a partially broken front view showing another embodiment of the machine according to the present invention.
Figure 9:
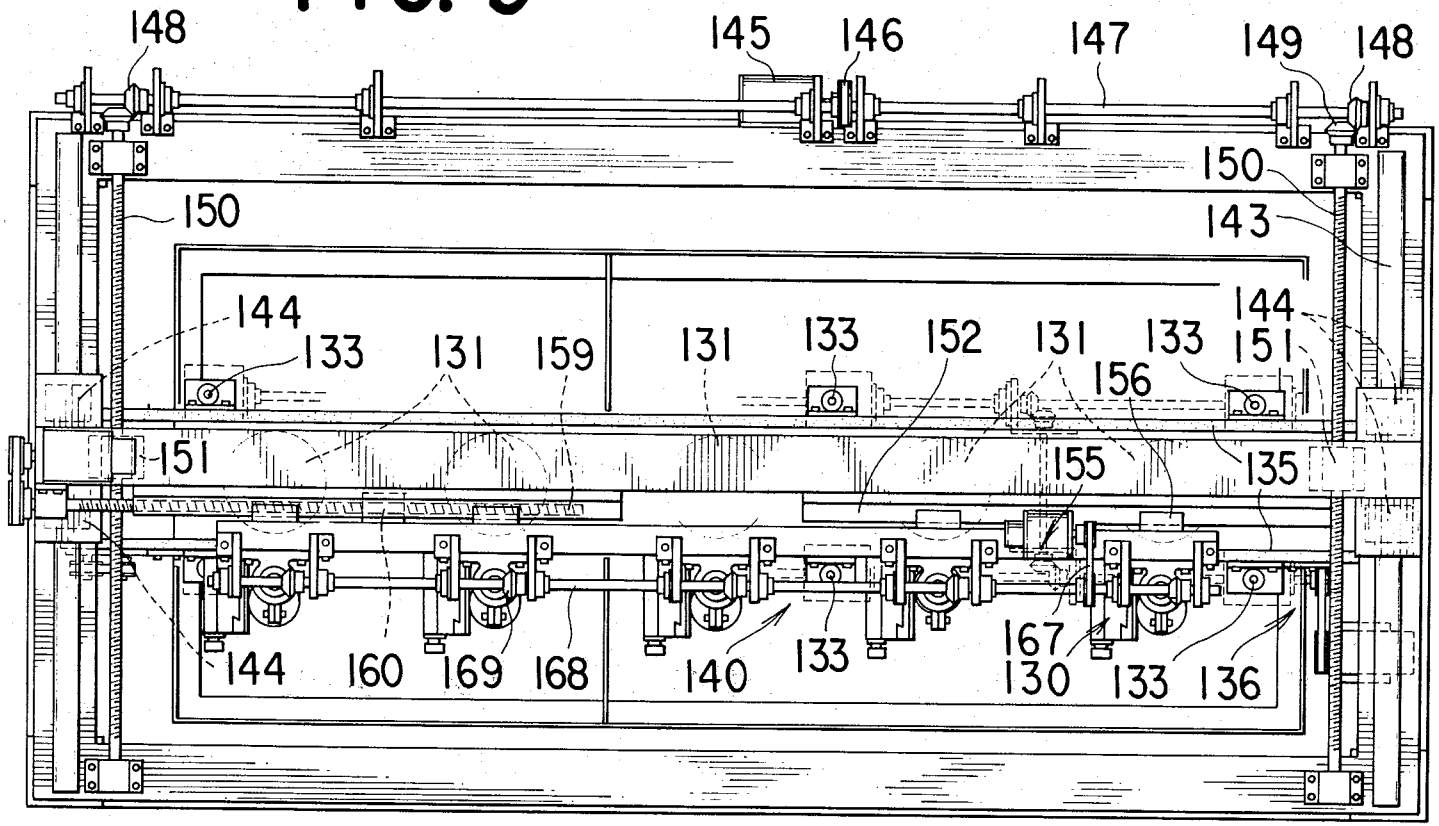
FIG. 9 is a top plane view of the same embodiment.
Figure 10:
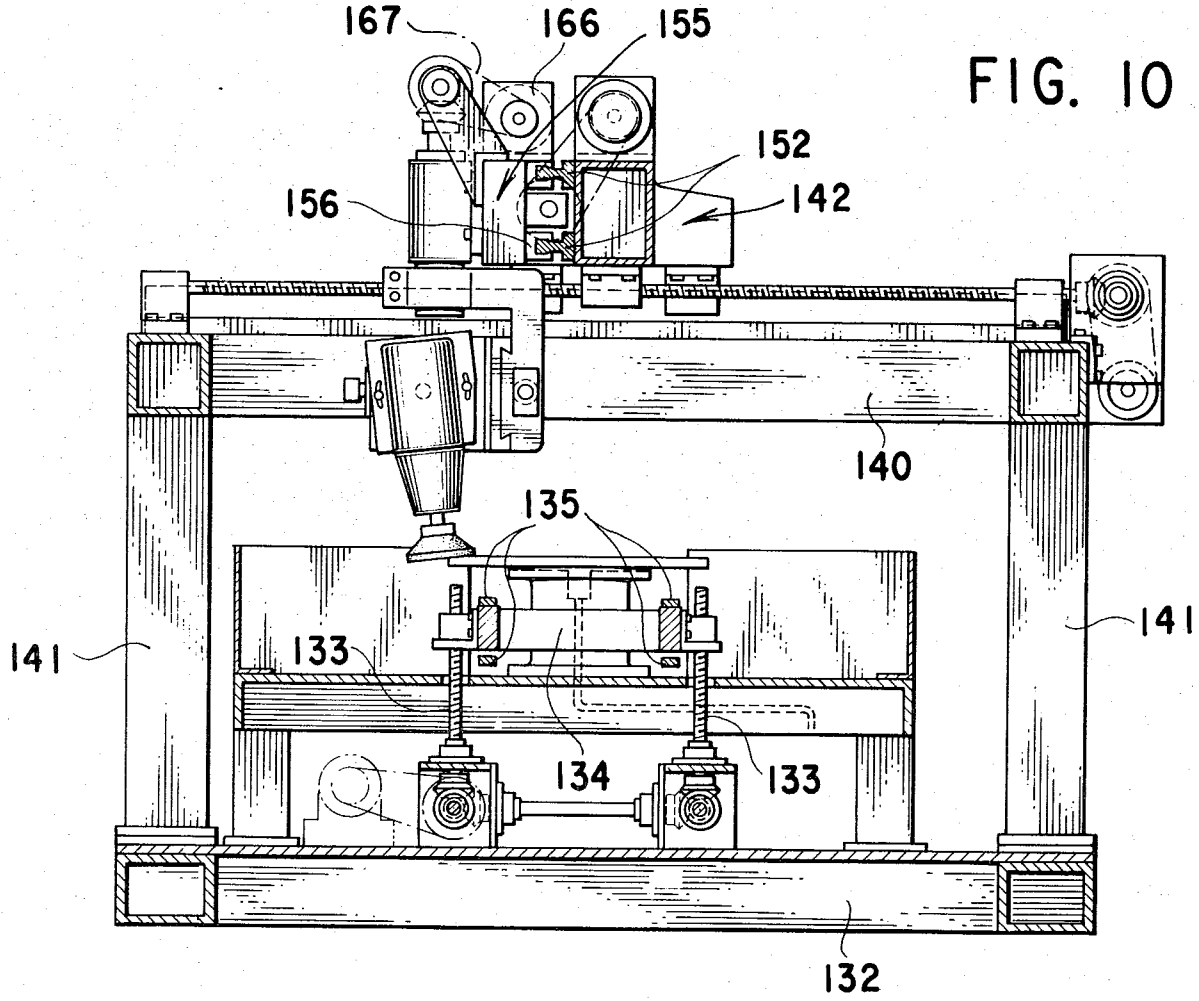
FIG. 10 is a cross sectional view taken along a line X—X of FIG. 8.

FIG. 8 through FIG. 10 show another embodiment of the glass plate beveling machine. While the table having a plurality of fixing stands with glass plates thereon can move in one direction (X axis) and the head stand can move in another direction (Y axis) in the previous embodiment, the table is fixed and the head stand is adapted to move biaxially (X axis and Y axis) in this embodiment.

A table 130 in this embodiment has five fixing stands 131 and it is secured to a base 132. Each of the fixing stands 131 is connected to a vacuum device (not shown) as in the foregoing embodiment to attract and set the glass plate placed thereon at a predetermined position during working. To a moving frame 134 supported by thread shafts 133 movably vertically to the table 130 and constructed frameworkedly, are disposed two belts 135 and 135 along both sides of the fixing stands 131 arranged in tandem to constitute a feeding means 136. As aforementioned embodiment, both belts 135 are driven through pulleys 198 by a motor 197 mounted to the moving frame 134. Each of the thread shafts 133 is rotated by bevel gears 140 engaged to thread shafts 139 longitudinally running along the table 130 and rotated from a motor 137 by way of a timing belt 138 and it is disposed on both sides of the moving frame 134 as shown in FIG. 10.

A cross stand 142 is adapted to be movable to a frame **140*a* rigidily connected to vertical frames 141 upwardly planted from four corners of the base 132 in the direction vertical to the drawing sheet (Y axis) in FIG. 8, and a head stand 155 is adapted to move right and leftwardly (X axis) to the cross stands 142 in FIG. 8. As a result, head stands 155 can move biaxially relative to the table 130 provided securely. Slide bearings 144 mounted to the lower side of the cross stand 142 are engaged on two rails 143, 143 secured on the frame 140***a* and the cross stand 142 is moved by bevel gears 148 secured on both ends of a shaft 147 rotated by way of a timing belt 146 from a motor 145, another bevel gears 149 engaging with the above bevel gears 148, thread shafts 150, 150 each having the bevel gear 149 at one end and nuts 151 fixed to the cross stand and meshing with the threaded shafts 150 as shown in FIG. 9.

Figure 12:
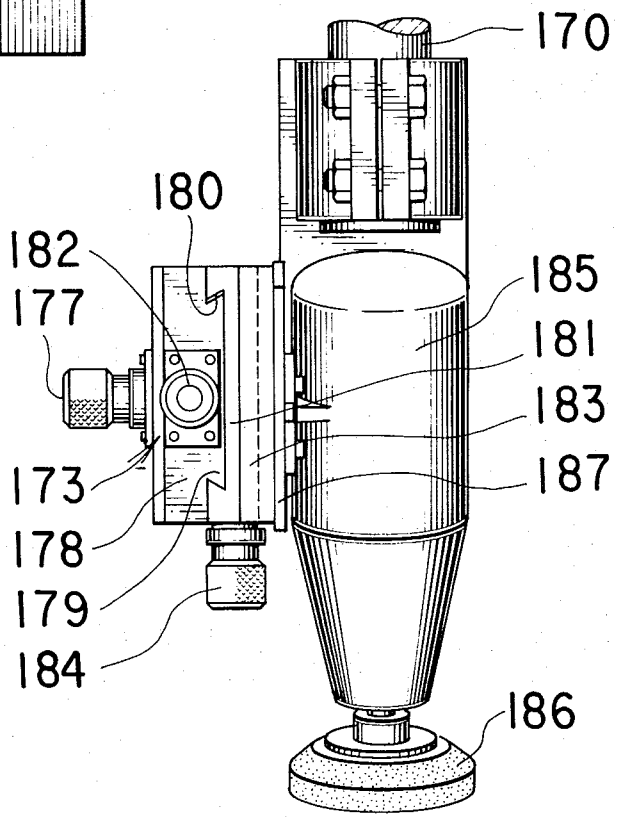
FIG. 12 is a front view of the same working head.
Figure 11:
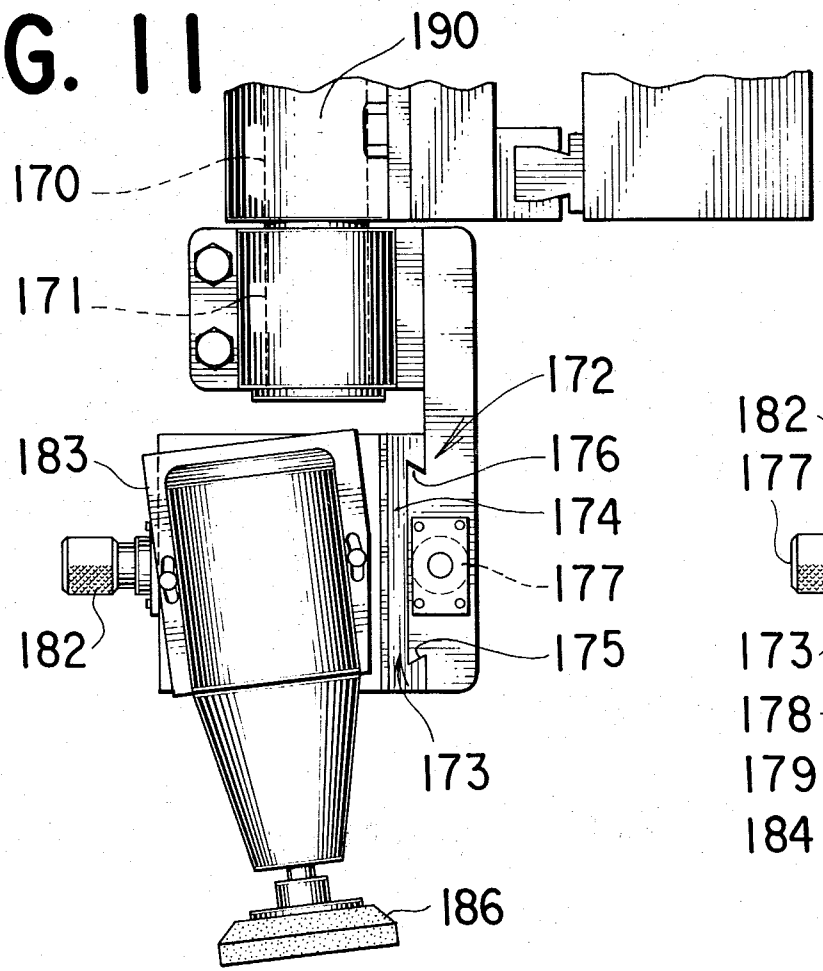
FIG. 11 is a side view of a working head for spinning.

As shown in FIG. 10, two rails 152, 152 are securely disposed on the upper and the lower sides of the cross stand 142. While on the other hand, slide bearings 156 engaging each of the rails are provided on a head stand 155, which is moved in biaxial direction (X and Y axes) on the cross stand 142 by way of a nut 160 securely provided to the head stand 155 and meshing with a thread shaft 159 rotated by way of a timing belt 158 from a motor 157 secured on the cross stand 142. As shown in FIG. 8, five working heads 161–165 are mounted on the head stand 155 at the positions corresponding to the five fixing stands 131 situated on the table 130 and each of the working heads is adapted to be spinned simultaneously by a shaft 168 and bevel gears 169 rotated by way of a timing belt 167 from a motor 166 secured on the head stand 155. In this embodiment, five working heads are provided in tandem, in which the working head 161 is for bevel-cutting, the working head 162 is for edging, the working heads 163 is for smoothing the bevel-cut surface, and the working heads 164, 165 are for polishing the smoothed surface. As shown in FIG. 11 and FIG. 12, each of the working heads has a rod 170 suspended rotatably but not axially movably against a housing 190 as the rod 100 above mentioned and a holder 172 securing its cylindrical mounting portion 171 to the lower end portion of the rod 170. The lower end of the holder 172 slidably supports a slide member 173 having a substantially L-like shape in plane. To the outside of one of the sides 174 of the L-like slide member 173, is formed a dovetail groove 175 which is engaged to a projection 176 in corresponding configuration provided to the holder 172 and it is adapted so that the slide member 173 can be advanced or retracted for the holder 172 by the rotation of a knob 177 having a screw mechanism known per se. To the inside of the other side 178 of the slide member 173, is formed a dovetail projection 179 which is engaged to the groove 180 of the second slide member 181 of a configuration corresponding to the projection 179 and the second slide member 181 is adapted to be advanced and retracted against the side 178 by a knob 182 having the same screw mechanism as above. Further, in a similar structure, a support plate 183 is adapted to be advanced and retracted vertically to the second slide member 181 by a knob 184 and a plate 187 attaching a motor 185 is mounted pivotably around the horizontal axis to the plate 183 as in the foregoing embodiment. As shown in FIG. 8, the edging heads 162 has also the same screw mechanisms. As shown in FIG. 8, each upper end of the rods 170 attaches a bevel gear 191 which engages with the bevel gear 169, accordingly when the shaft 168 is rotated through the timing belt 167 by the motor 166, each holder 172 attached fixedly to the rod 170 rotates around the vertical line, and consequently the wheels 186 and 194–196 spin around the vertical axis going through the grinding portion. In this embodiment, a motor shaft 193 attaching the edging wheel 192 thereon is adjusted to make its axis position vertically, and the edging wheel 192 is also spinned as the other wheels 186 and 194–196.

Meanwhile in the above second embodiment, the constitution other than the parts described before is substantially the same as of the first embodiment. Further in the second embodiment, the grinding wheels 186 and 194–196 can be replaced by the edging wheels. In this case, the edging wheels which replace the grinding wheels need to dispose their rotating axis vertically in the same way as the edging wheel 192. This disposition can be achieved by pivoting the plate 187 around the horizontal axis. In the above second embodiment, each working head has the screw mechanisms which control the central position of rotation of the working wheels, therefore by the screw mechanisms, the spinning center of the working wheels or the center of the rods 170 and the rotating center of the working wheels can be relatively shifted.

Figure 14:
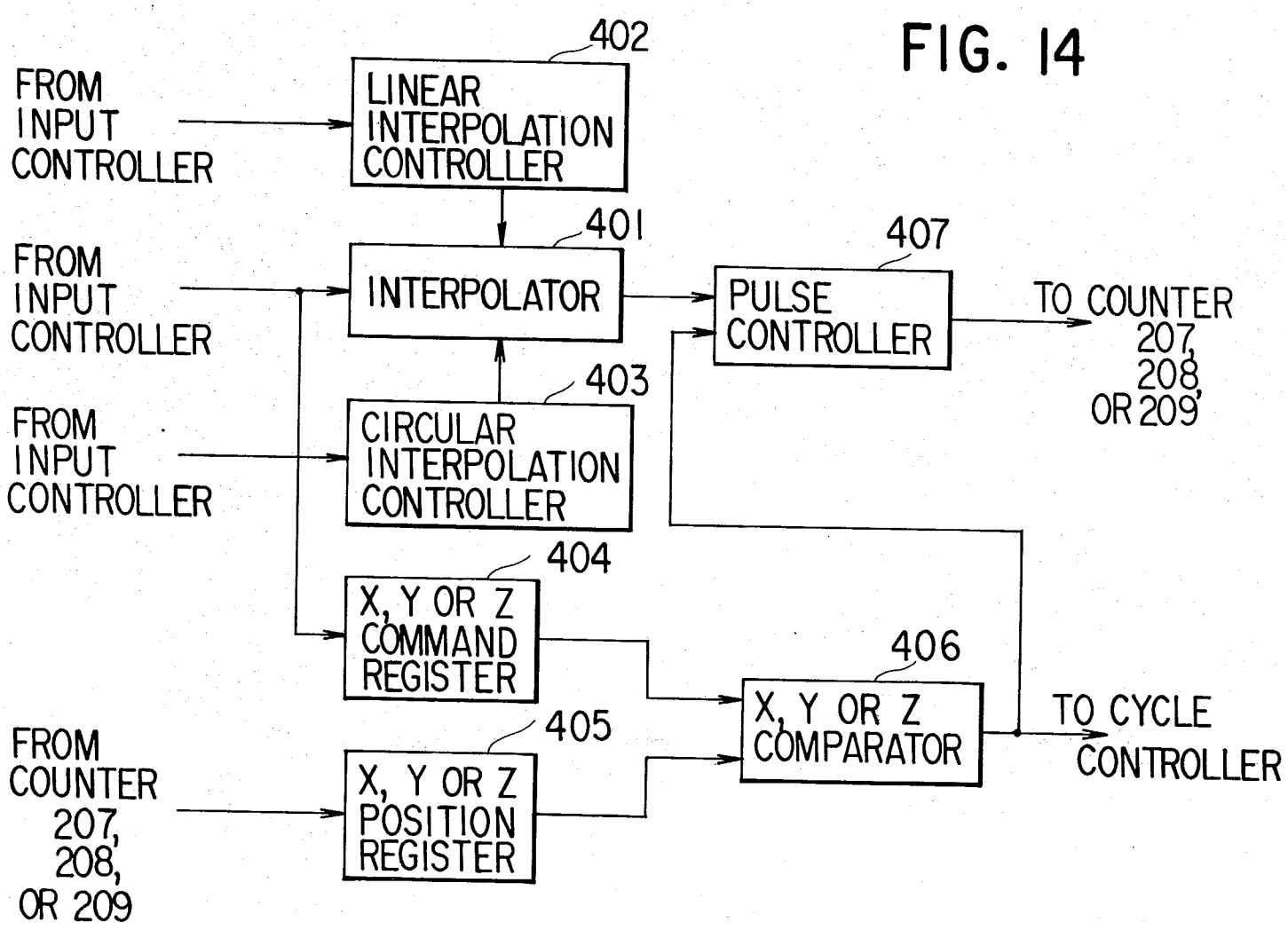
FIG. 14 is a block diagram of operation circuit.

The beveling machine having the above constitution can be operated under the control of a numerical control device 200 as shown in FIG. 13. Known numerical control device can be used for the device 200 and the basic structure and the operation to the beveling machine shown in FIG. 1 are as follows. An input unit 201 consists of a paper tape reader 202 for reading function data and numerical data programmed and punched in a paper tape, and input controller 204 for controlling the operation of the reader 202, interpreting the read out data and transferring it to a subsequent processor unit 203 and an operation panel 205 provided with function switches for the instruction of a specific operation to the control unit 200 and indicators for the indication of the operation state in the control unit 200. A processor unit 203 consists of a processing circuit 206 for the interpolating calculation of the moving amounts in the directions of X axis and Y axis and the revolutional amounts around Z axis of the working heads 61–64 resulted by the servo motors 35, 70 and 110 based on the data from the input controller 204, position counters 207, 208 and 209 for counting the pulses generated from the processing circuit 206 as the result of the procession, and a cycle controller 210 for defining the operation cycle of the control device 200. The processing circuit 206 is designed as a so called known "Digital Differential Analyzer" which compares the coordinate value for the moving destination read from the reader 202 and the coordinate value for the present position set to the position counter 207, 208 or 209 and interpolates the difference in the comparison, if any, successively either linearly or circularly to determine the amount to be controlled. Accordingly, the processing circuit 206 contains, as shown in FIG. 14, an interpolator 401, a linear interpolation controller 402 and a circular interpolation controller 403 for the control of the interpolator 401, a command register 404 storing the coordinate value for the moving destination, a position register 405 for storing the coordinate value for the present position, and a comparator 406 for comparing the content in the registers 404 and 405 and delivering the compared result to the cycle controller 210 and a pulse controller 407, which issues the interpolated amount based on the compared result from the comparator 406 to the counter 207, 208 or 209 as a pulse. The registers and the comparator are provided for the control of the movements in the directions of X axis and Y axis, as well as around Z axis respectively. An X-counter 207, a Y-counter 208 and a spin-counter 209 respectively count the pulses as the result of the procession delivered from the processing circuit 206 and operate each of the servo circuits 212, 213 and 214 in a servo unit 211. Each of the servo circuits 212, 213 and 214 actuates the corresponding servo motors 35, 70 and 110 respectively based on the corresponding counted value. Each of the servo circuits is designed so that the amount of displacement resulted from the actuated motor is detected by inductosyns or resolvers and tacho-generators 215, 216 and 217 for the control of position or angle and speed. Since such position control and speed control effected by the inductosyns or resolvers and the tacho-generators 215, 216 and 217 are well known in the art of automatic control technology, no particular descriptions are made.

The beveling machine shown in FIG. 1 can desirably be controlled by the above numerical control device 200 and the outline of its controlling operation is as follows. Upon actuation of a start switch on a main operation panel 218 provided on the side of the beveling machine, a start signal is applied to the input of the cycle controller 210 and the cycle controller 210 instructs the input controller 204 to read the data from the reader 202. Then, the data programmed on the tape are read out from the reader 202, interpreted in the input controller 204 and then applied to the input of the processing circuit 206. It is assumed here that the glass plates G have already been placed and fixed to all of the stands 31 and the heads 61, 62, 63 and 64 have been situated to their original positions for the starting of grinding work. Accordingly, the data supplied then to the processing circuit 206 concern the moving amounts in the directions of X axis and Y axis, as well as the revolutional amounts around Z axis and they are supplied to the corresponding command registers 404. The value given to the command register 404 is compared with the value in the position register 405 indicating the present position, that is, the original position and, when a signal indicative of the difference in the above comparison is applied to the pulse controller 407, the pulse controller 407 successively supplies a signal from the interpolator 401 to the counter. It can be set by a program whether the linear interpolation or the circular interpolation is conducted and, upon setting of the linear interpolation for example, the interpolar 401 is operated under the control of the linear interpolation controller 402. Consequently, the interpolator 401 at first delivers a signal indicative of a small movement along X axis to the pulse controller 407 and the pulse controller 407 supplies a series of pulses to the counter 207 for setting a value corresponding to the above movement to the counter 207 based on the above signal. When the counter 207 is set to such a value, the servo circuit 202 receiving it actuates the servo motor 35 so as to move the table 30 slightly in the direction of X axis. When the servo motor 35 is driven, the shaft 36 is rotated to move the table 30 in the direction of X axis and small displacement are resulted in the position of the stand 31, that is, the positions of the glass plates G relative to the wheels 75, 76, 77 and 78 provided to each of the heads in the direction of X axis. After that, during working for the glass plates G by the wheels 75, 76, 77 and 78 rotated by the head motors 80 and 95 already in running, the small displacement is resulted to the working positions in the direction of X axis. The small displacement and the moving speed produced by the servo motor 35 are detected by the inductsyn and the tacho-generator 215 and fed back to the servo circuit 212 to be set correctly. Then, the moving amount in the direction of Y axis set to the Y axis-command register 404 and the value of the position register 405 indicating the present position in the direction of Y axis, that is, the original position in Y axis are compared and, when a signal indicative of a difference in the comparison is supplied to the pulse controller 407, the pulse controller 407 issues a pulse indicative of a small displacement to a counter 208 based on the signal from the interpolator 401. When the counter 208 is set to such a value, the servo circuit 213 receiving it actuates the servo motor 70 so as to move the heads 61, 62, 63 and 64 slightly in the direction of Y axis. This causes the shaft 68 to rotate and the head stand 60 is moved in the direction of Y axis to result small Y axis displacement in the positions of the wheels 75, 76, 77 and 78 provided to each of the heads relative to the glass plates G. Consequently, the working positions for the glass plates G are displaced slightly in the direction of Y axis during working for the glass plates G by wheels 75, 76, 77 and 78 rotated by the head motors 80 and 95. The small displacement in the positions and the moving speed produced by the servo motor 70 are detected by the inductsyn and the tacho-generator 218 and then fed back to the servo circuit 213 to be set correctly. Further, the spinning amount set to the spin-command register 404 and the value in the position register 405 indicating the present positions, that is, the original positions around Z axis are compared and, when a signal showing a difference in the comparison is applied from the comparator 406 to the pulse controller 407, the pulse controller 407 issues a pulse indicative of the small displacement to the counter 209 based on the signal form the interpolator 401. When the counter 209 is set to a value for the small displacement by this pulse, the servo circuit 214 actuates the servo motor 110 so as to revolve the heads 62, 63 and 64 slightly around Z axis. Upon driving of the servo motor 110, the timing belt 109 is caused to run, whereby each of the pulleys 106, 107 and 108 is rotated and the heads 62, 63 and 64 revolve around Z axis. This results in a small displacement around Z axis in the positions of the wheels 76, 77 and 78 provided to each of the heads retative to the glass plates G. Consequently, small displacement is resulted in the working positions around Z axis during working for the glass plates G by the wheels 76, 77 and 78 rotated by the head motor 95. The small change in the angle and the moving speed produced by the servo motor 110 are detected by the resolver and the tacho-generator 217 and fed back to the servo circuit 214 to be correctly. The interpolating operation concerning for one step relative to the directions of X axis and Y axis, as well as around Z axis has thus been conducted, and the position register 405 indicating the present positions relative to X axis and Y axis and around the Z axis is set with the contents of the counters 207, 208 and 209, that is, the positions after the movement. Then, after the interpolating operation for the one step, the contents of the command register 404 and the position register 405 are compared again corresponding to each of the axes and, if there is any difference in the contents, the foregoing operations are repeated to renew the content in the position register. On the contrary, where the content in the command register 404 and that in the position register 405 are coincided, the comparator 406 issues a signal for instructing reading of the succeeding data to the cycle controllers 210 which, in turn, instructs the controller 204 to read out the data and the input controller 204 interpretes the data read out from the reader 202 and supplies the data again to the processing circuit 206. If the data indicate the next moving destination, the data are stored in the corresponding command register 404. The new data storage to the command register 404 is not always effected simultaneously regarding X axis, Y axis and Z axis, but some time they may be conducted individually if the moving amounts are different. When the new moving destination is set again to the command register 404, the interpolating operating is performed again and the table 30 and each of the heads are moved and spun in specified amounts respectively regarding X axis, Y axis and around Z axis. Working for the glass plates G are thus be conducted successively based on the programmed data and, finally, when the data for the original positions regarding X axis, Y axis and around Z axis, that is, the home positions are read out from the tape reader 202, the processing unit 203 repeats the interpolating operation to the original positions as in the foregoings to set the working points for each of the wheels 75, 76, 77 and 78 to the glass plates G to the home positions. When the table 30 and each of the heads 61, 62, 63 and 64 are set again to the original positions, each comparator 406 indicates this state to the cycle controller 210. Then, the cycle controller 210 issues a signal to the input controller 204 for reading out the next data from the reader 202 which, in turn, interpretes the data from the reader 202 and supplies the data to the processing circuit 206. Since the data thus read out are for moving the heads 61, 62, 63 and 64 from the working positions in certain amounts, for example, by certain amounts rightwardly from the position shown in FIG. 2, the data for the moving destination are set only to the Y axis-command register 404 and the servo circuit 213 operates to actuate the servo motor 70 based on the value set in the Y-command register 404. Accordingly, the shaft 68 is rotated to displace each of the heads 61, 62, 63 and 64 each in a certain amount from the working position regarding Y axis. If the content in the Y axis-command register 404 and that in the position register 405 are coincided, the operation of the pulse controller 407 is stopped and, at the same time, the servo circuit 213 stops the operation of the servo motor 70, and the cycle controller 210 instructs the input controller 204 to read out the next data from the reader 202. Based on this instruction, the input controller 204 reads out the data punched in the tape from the reader 202 and interpretes the read out data. The data read out are the data used for interrupting the operation of the vacuum device 38 to release the vacuum attraction for the glass plates G onto the stands 31, actuating the hydraulic cylinder 54 so as to result in the elevation of the glass plates G by the belt conveyor 51 by way of the frames 52, 52, and thereafter actuating the motor 58 so as to convey each of the glass plates G respectively to the subsequent stands 31. Upon reading out the above data, the input controller 204 issues a control signal to respective driving control units (not shown), and the control units interrupt the operation of the vacuum device 38, actuate the hydraulic cylinder 54 and operate the motor 58. The motor 58 thus drived runs the belt conveyor 51 and all of the glass plates G carried thereon are moved, for example, leftwardly in FIG. 1, so that each of the glass plates G is conveyed to the succeeding stand 31. A new glass plate which is to be worked is mounted manually or automatically on the rightmost stand 31. When each of the glass plates is correctly conveyed to the succeeding stand it is detected by an adequate detector (not shown) and the respective driving control units, upon reception of a signal from the detector, stop the operation of the motor 58, at the same time, actuate the hydraulic cylinder 54 for releasing the elevation of the glass plates G by the belt conveyor 51 and actuate the vacuum device 38 for the vacuum attraction of the glass plates G onto the stands 31. After the completion of these operations, each of the control units issues an operation completion signal to the cycle controller 210. Then, the cycle controller 210 instructs the input controller 204 to read out the data again from the reader 202, whereby the input controller 204 reads out the next data from the reader 202 and interpretes them. The data thus read out contain an instruction signal for returning the heads 61, 62, 63 and 64 to the original points and the coordinate values for the original points, which are again transferred to the processing circuit 206. By the way, since the heads 61, 62, 63 and 64 are displaced from the original points only with respect to Y axis as foregoings, the processing circuit 206 performs the operation only with respect to the Y axis direction. Accordingly, the servo circut 213 is operated by the signal issued from the counter 208 for actuating the servo motor 70 and the heads 61, 62, 63 and 64 are moved leftwardly in the relation as shown in FIG. 2 and returned to the original positions. The content in the command register 404 and that in the position register 405 are thus coincided and a coincidence signal is applied to the input of the cycle controller 210, which issues an instruction signal to the input controller 204 for reading out the data from the reader 202 in order to conduct the next working. The subsequent procedures are the same as above, in which the processing unit 203 performs an interpolating operation based on the data obtained from the input controller 204 and supplies the result to the servo unit 211. Then, the servo unit 211 actuates each of the servo motors 35, 70 and 110 to move the table 30 and each of the heads corresponding to the working points for the glass plates G respectively. Such control operation by the numerical control device 200 can desirably be applied also to the machine as shown in FIG. 8 by properly modifying the program and the circuit structure.

What is claimed is:

1. A method for grinding glass plates through numerical control comprising fixing the glass plates on a plurality of fixing stands mounted on a table, and relatively moving the glass plates and working wheels in biaxial directions in a horizontal plane while rotating each working wheel held on each of a plurality of working heads mounted opposing each fixing stand respectively as well as spinning each working wheel around a vertical axis going through a working point so that each working wheel works the glass plate to be worked at substantially the same portion of a working face, wherein the movement in the horizontal plane of the glass plates and the working wheels and the spinning movement of the working wheels are controlled by numerical control means, and after finishing one grinding process on one fixing stand, the glass plates are conveyed to the succeeding fixing stand for an additional grinding process.

2. A method according to claim 1, wherein the working faces of the working wheels excluding one for edging are disposed at an incline to the glass plates and in contact with the glass plates, said each inclined working face being always kept at substantially the same contact angle with that of the glass plate.

3. A method as claimed in claim 1 or 2, wherein a plurality of fixing stands are arranged in tandem.

4. A beveling machine for glass plates comprising a table having a plurality of fixing stands for fixing the glass plates, a head stand carrying a plurality of working heads each having a rotatably mounted working wheel respectively, means for moving the head stand in one direction in a horizontal plane so as to move a plurality of working wheels in one direction in the horizontal plane, means for moving the table or the head stand in the direction perpendicular to the above one direction in the horizontal plane so as to cause a plurality of working wheels in a relative movement to the direction perpendicular to the above one direction in the horizontal plane, a plurality of means mounted on the above head stand for spinning the respective working wheels, said wheels being inclined from a vertical axis in a specified number of working heads exclusing at least one of the above working heads around said vertical axis, and a numerical control means for controlling the movements in the biaxial directions in the horizontal plane of the working wheels and the spinning movement around the vertical axis of the inclined working wheels, each means for spinning working wheels carried by said head stand being provided with a rod rotatably mounted by a bearing device, said rod being provided with said working head, the portion of each of the rods projecting from the bearing devices being so connected to each other by transmission means and also to driving means so each rod receives the same movement, the spinning center of each of the inclined working wheels being situated so as to go through the working point and also to align with the center of said rod.

5. A machine according to claim 4, wherein one of the working wheels is a disk-like wheel for edging and the others are cup-like wheels for grinding and finishing.

6. A machine according to claim 4, the working wheels of which are disk-like wheels for edging.

7. A machine according to claim 4, the working wheels of which are cup-like wheels for grinding and finishing.

8. A machine according to claim 4, 5, 6 or 7 further comprising a feeding means disposed along a plurality of the fixing stands in tandem, said feeding means being supported movably in a vertical direction by a screw mechanism and conveying the glass plates to the succeeding fixing stands after receiving said glass plates on the feeding means when the feeding means moves upwardly and being distant from the glass plate when the feeding means moves downwardly.

9. A beveling machine for glass plates comprising a table having a plurality of fixing stands for fixing the glass plates, a head stand carrying a plurality of working heads each having a respective rotatably mounted working wheel, means for moving the head stand in one direction in a horizontal plane so as to move a plurality of working wheels in one direction in the horizontal plane, means for moving the table or the head stand in the direction perpendicular to the above one direction in the horizontal plane so as to cause a plurality of working wheels to be moved in a direction perpendicular to said one direction in the horizontal plane, a plurality or means mounted on said head stand for spinning around a respective vertical axis all working wheels provided on each of the above working heads, means for shifting the rotating center of the working wheel with respect to the spinning center, a numerical control device for controlling the movements in the biaxial directions in the horizontal plane of the working wheels and the spinning movement around the vertical axis, and a feeding means for automatically conveying the glass plate to a succeeding fixing stand, said each means for spinning working wheels carried by said head stand being provided with a rod rotatably mounted by a bearing device, said rod being provided with said working head, the portion of each of the rods being so connected to each other by transmission means and also to driving means that each rod receives the same movement, the spinning center of each of said working wheel being situated so as to go through a working point and also to align with the center of said rod, whereby after finishing one grinding process on one fixing stand, the glass plate is conveyed to the succeeding fixing stand for a next grinding process.

10. A machine as claimed in claim 9, wherein each means for shifting the rotating center of working wheel with respect to the spinning center includes respectively two sets of screw mechanism and a slide-member, said means being adapted so as to feed the rotating center of the working wheel in two directions perpendicular to each other.

11. A machine as claimed in claim 9 or 10, wherein one of the working wheels is a disk-like wheel for edging and the others are cup-like wheels for grinding and finishing.

12. A machine as claimed in claim 9 or 10, the working wheels of which are disk-like wheels for edging.

13. A machine as claimed in claim 9 or 10, the working wheels of which are all cup-like wheels for grinding and finishing.

14. A machines as claimed in any of the preceding claims 9 or 12, wherein said feeding means is disposed along a plurality of fixing stands in tandem and supported movably in a vertical direction so as to convey the glass plate to the succeeding stand after receiving said glass plate on said feeding means when moving upwardly and is distant from the glass plate when moving downwardly.

* * * * *